United States Patent [19]

Naumann et al.

[11] Patent Number: 4,703,631

[45] Date of Patent: Nov. 3, 1987

[54] WARP KNITTING MACHINE

[75] Inventors: Rolf Naumann, Muhlheim/Main; Christian Wilkens, Heusenstamm, both of Fed. Rep. of Germany

[73] Assignee: Karl MAYER Textilmaschinenfabrik, Fed. Rep. of Germany

[21] Appl. No.: 806,747

[22] Filed: Dec. 9, 1985

[30] Foreign Application Priority Data

Dec. 28, 1984 [DE] Fed. Rep. of Germany ..... 3447643

[51] Int. Cl.[4] ..... D04B 23/06

[52] U.S. Cl. ..... 66/84 A

[58] Field of Search ..... 66/84 A, 85 A

[56] References Cited

U.S. PATENT DOCUMENTS

| | | | |
|---|---|---|---|
| 3,321,348 | 5/1967 | Rupp | 66/84 A X |
| 3,756,043 | 9/1973 | Kemter | 66/84 A |
| 4,325,999 | 4/1982 | Campman et al. | 428/112 |
| 4,380,913 | 4/1983 | Wilkens | 66/84 A |
| 4,385,506 | 5/1983 | Mista | 66/84 A |
| 4,395,888 | 8/1983 | Wilkens | 66/84 A |
| 4,442,684 | 4/1984 | Bergmann et al. | 66/84 A |
| 4,463,580 | 8/1984 | Hittel et al. | 66/84 A |
| 4,518,640 | 5/1985 | Wilkens | 66/192 X |
| 4,556,440 | 12/1985 | Krueger | 156/181 |
| 4,567,738 | 2/1986 | Hutson et al. | 66/84 A |

FOREIGN PATENT DOCUMENTS

| | | | |
|---|---|---|---|
| 45-33874 | 10/1970 | Japan | 66/85 A |

OTHER PUBLICATIONS

Bahlo, K. W., "New Fabrics without Weaving", Modern Textiles magazine, Nov. 1965, pp. 51 to 54.

*Primary Examiner*—Ronald Feldbaum
*Attorney, Agent, or Firm*—Omri M. Behr

[57] ABSTRACT

The invention is directed to a warp knitting machine having a weft thread insertion arrangement comprising two parallel transfer devices which carry the weft threads in holders having a predetermined separation from each other and which are driveable in the direction of the needle bed. Also included is a reciprocally moveable weft sled arrangement carrying thread guides to lay mutually crossing layers of diagonal weft threads that subtend mutually opposed angles to the stitch rows. The guides place the threads into the weft thread holders first in one of said transfer devices and then in the other transfer device in exact and predetermined separations. The invention is further directed to a novel fabric having inlaid weft and warp inlay threads.

11 Claims, 6 Drawing Figures

A
B
C
D
E
F
G
H
I
D1
D11
41
42
20
DS
45
44
43
39
40
P1
PF 1
PF 2
PF 3
PF 4
30
D9
22,5°
5
K1
K2
K3
K4
K5
K6
K7
K8
K9
K10
13
12
3
16

A
B
C
D
E
F
G
H
I
DS
20
49
48
47
46
43
5
13
12
16
3
K1
K2
K3
K4
K5
K6
K7
K8
K9
K10
22,5°

WARP KNITTING MACHINE

BACKGROUND OF THE INVENTION

The present invention is related to a warp knitting machine having a weft thread insertion arrangement comprising two parallel transfer means which carry the weft threads on spaced holders and which are driveable in the direction of the needle bed; and a reciprocally moveable weft sled arrangement carrying thread guides to lay mutually crossing layers of diagonal weft threads subtending mutually opposed angles to the stitch rows.

In particular, the guides place the threads onto the weft thread holders, first to one of said transfer means and then to the other with exact and predetermined separations. The invention is further directed to a novel fabric having inlaid weft and warp inlay threads.

In a known warp knitting machine of this type, U.S. Pat. No. 4,395,888 to Wilkens, the sled carries weft thread guides which have an operative and an inoperative position. In the operative position the threads are placed in the openings between the weft thread holders. In the inoperative position the threads are led past the weft thread holders. When such weft thread guides are in their direction-changing position outside the holders the sled is displaced in a rearward direction by a number of holder divisions corresponding to the number of weft thread guides. This backwards movement is followed by an angled motion that this displacement is compensated out. If the weft thread guides are always in the operative position, there is provided a horizontal, parallel weft insertion. If they are brought for a time into their inoperative position, then a diagonal weft is provided. The number of weft thread guides is generally speaking 12, 18 or 24.

Another warp knitting machine is known (NL-OS 83 03 737) which comprises two weft threads each on a straight fixed guide upon which it may move in a reciprocal manner. The weft threads, at their turning position, are irregularly pressed into the spaces between the weft thread holders by a pressing rail. In order to provide a horizontal weft, the weft sled moves perpendicular to the direction of transfer. For the provision of a diagonal weft, the sled runs in the desired angle to the transfer means. Even here, it is necessary to utilize two weft sleds when it is desired to provide mutually crossing layers of diagonal weft thread.

Furthermore, a knitted fabric is known (U.S. Pat. No. 4,518,640 to Wilkens) in which, as reinforcing threads, two layers of mutually crossing diagonal weft threads, namely a warp inlay thread layer and a horizontal weft thread layer are bound into a knitted fabric. This gives rise to a thread structure which is extremely stable in all directions. Such a fabric can, for example, be covered with synthetic materials and thus serves as a matrix or as a laminate for the formation of synthetic forms of extreme stability. The inlaid threads can be of rather stiff material, for example, glass or carbon fibers. In order that the coating occurs in a regular manner and that even strength is achieved, the weft threads must be inserted in an exact and predetermined separation.

Since diagonal weft threads lead to a rise in the stability in the diagonal direction, they must subtend a substantial angle to the stitch wales, this angle should be at least 20°. It is preferable that this angle be 45°. However, it can be even greater, for example, as much as 70°.

Accordingly, there is a need for a wrap knitting machine of the heretofore discussed type which permits mutually crossing layers of diagonal weft threads to be placed in exact and predetermined separation, with just one weft sled. A greater number of weft thread sleds can of course be employed in addition.

SUMMARY OF THE INVENTION

In accordance with the illustrative embodiments demonstrating features and advantages of the present invention, there is provided a warp knitting machine having a bed of needles and a magazine for weft threads. The machine has a pair of endless transfer means each having weft thread holding means, spaced with a predetermined spacing, for retaining the weft threads in parallel and delivering them to the needle bed in a predetermined direction. Also included is a weft thread sled means having a plurality of thread guides for reciprocating between the pair of transfer means to insert the weft threads in mutually and diagonally crossing layers. Each of the layers has a mutually opposed orientation to stitch wales produced by the needles. The layers run alternately between the weft thread holding means of each of the transfer means. The thread guides are greater in number than the needles. The thread guides are operable when reversing direction to lay each of the weft threads around only one weft thread holding means at that time. The weft thread sled means is operable to move transversely to the predetermined delivery direction at a reciprocating speed to lay the weft threads of at least one of the thread guides, proximal to the needle bed in a position, next to and displaced by one transfer means division from, at least one of the weft threads laid by at least one of the thread guides distal to the needle bed in an earlier cycle.

By employing apparatus of the foregoing type an improved warp knitting machine is achieved. In a preferred embodiment, a number of thread guides provided on each weft thread sled is greater than the number of needles in a needle bed. Preferably, the thread guides at their turn-around position, lay each diagonal weft thread only about one weft thread holder. In one embodiment, the sled reciprocates substantially perpendicularly to the transfer directions at such a speed that the diagonal weft threads laid by the thread guides proximal to the needle bed will be displaced by one holder division and placed next to diagonal weft threads laid in a previous cycle by thread guides distal to the needle bed.

Because of the substantial number of thread guides, it is possible, utilizing a reciprocating movement of the thread to provide both mutually crossing layers of diagonal threads. The layers subtend similar but opposite angles. By displacement over only one holder division, an extremely exact placement of the diagonal weft threads is possible so that the newly laid threads lie in exact placement, adjacent to the layer of previously laid threads.

In a preferred embodiment a diagonal weft sled is provided between two horizontal weft sleds. In this fashion, a layer of warp inlay threads is providable before and after the diagonal weft sleds. Additionally, at least one arrangement can provide a cover layer from a layer of warp inlay threads laid proximate to the needle bed.

A novel wrap knitting machine built according to the principles of the present invention permits the creation of a new type of fabric with inlaid weft and warp inlay threads so that four layers of diagonal weft threads with alternately opposed direction lie on top of each other. In this fabric layers of diagonal weft threads with similar orientation are still located above each other.

BRIEF DESCRIPTION OF THE DRAWING

The above brief description as well as other features and advantages of the present invention will be more fully appreciated by reference to the following detailed description of a presently preferred but nonetheless illustrative embodiment in accordance with the present invention when taken in conjunction with the accompanying drawings, wherein.

DETAILED DESCRIPTION OF THE PREFERRED EMBODIMENT

Figure 1:
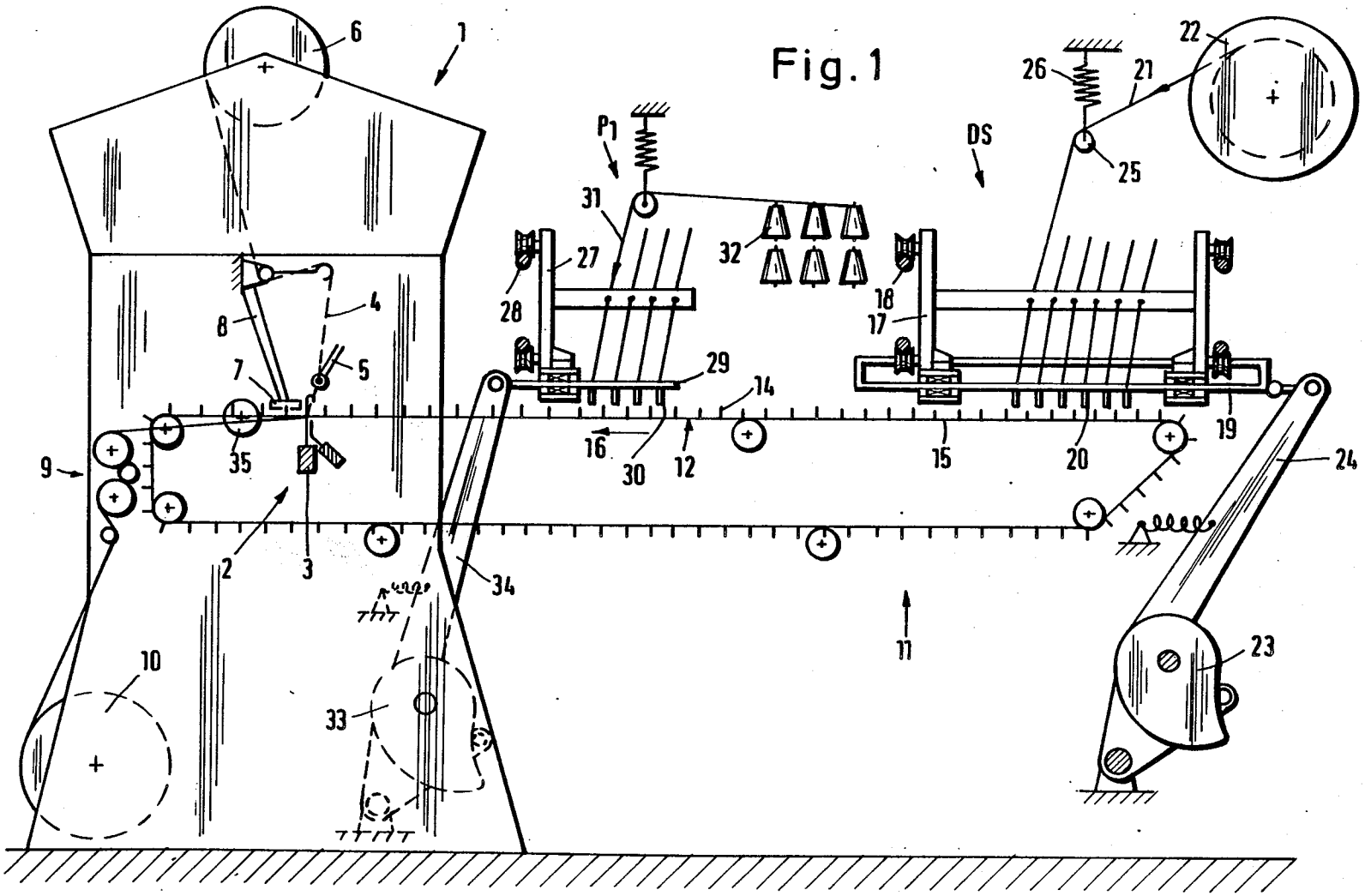
FIG. 1 is a schematic, side elevational view of a machine according to the principles of the present invention.

The warp knitting machine 1 illustrated in FIG. 1 comprises a general working area 2 having a needle bed 3 to which warp threads 4 are provided via thread guides 5 from a warp beam 6. To needle bed 3, a flat beam 7 is provided as a hold-down means. Beam 7 may be an elongate bar parallel to needle bed 3. Beam 7 can be held in a predetermined position by lever 8 activated from above to keep the fabric from lifting when the needles of the bed 3 are entering the work area. For better machine maintenance, hold-down lever 8 is collapsible. Very often it is possible to position the reinforcing material (described hereinaafter) to permit the needles of bed 3 to run between the residual interstices between the reinforcing threads. It is also possible to actually run the needles of bed 3 through the reinforcing threads. In such a case, however, holding down means 7 controlled by lever 8 from above, interferes with the upward movement of the reinforcing threads. There are provided, in the conventional manner, fabric take-off rollers 9 and fabric take-up rollers 10.

A magazine weft thread arrangement 11 comprises two transfer means 12 and 13, each in the form of an endless loop for carrying weft thread holders 14. Holders 14 are equally spaced, projecting knobs mounted on and driven by horizontal belt 15 in the direction of arrow 16. Transfer means 12 and 13 are located under the path of a diagonal weft thread sled DS and under the path of a parallel weft thread sled P1. The diagonal weft thread sled DS has a wheeled frame 17 which is driveable perpendicular to the transfer means 12 and 13 on guide means 18, a pair of transverse parallel rails. Carrier 19 is slidably mounted on frame 17 and carries a plurality of weft thread guides 20. Guides 20 feed diagonal weft threads 21 from warp beam 22. In order to maintain the threads under tension there is provided a turning roller 25 which is biased by spring 26.

The carrier 19 is longitudinally displaceable over one division of the weft thread holders 14 by means of an eccentric cam 23. Cam 23 is rotatably mounted to act through control lever 24.

A horizontal weft thread sled P1 similarly comprises a wheeled frame 27 which is moveable in a transverse direction on guides 28, another pair of parallel rails. Carrier 29, mounted to slide longitudinally in frame 27, supports weft thread guides 30. Horizontal weft threads 31 from a creel 32 are routed through guides 30. Carrier 29 in frame 27 may be displaced over several divisions of the weft thread holders 14 by means of an eccentric cam 33 rotatably mounted below carrier 29. Cam 33 act upon transfer lever 34.

Needless to say, the spools of the creel 32 can also be replaced by a warp beam. Similarly the warp beam 22 can be replaced by a creel.

In this preferred embodiment of the invention, a separating arrangement is provided which separates weft threads from the weft thread holders 14 on the far side of the needle bed 3 but not prior to the fifth needle cycle after the needle bed 3. This ensures that diagonal threads are adequately secured in the fabric before they are separated from the weft thread holders. Accordingly, a separating arrangement 35 may be provided downstream of the working region 2 which permits the laid weft threads to be separated from holders 14 of transfer means 12 and 13. This separating arrangement 35 is located in a position not closer than five working cycles from the needle bed 3. It can comprise a cutting wheel for cutting threads proximate to the holders 14. Alternatively, a means such as a lifting wheel can detach the threads from the holders 14.

In some cases, it is advantageous to the achievement of an exactly positioned placement of the diagonal weft threads that the weft thread holders 14 on each of the transfer means 12 and 13 are displaced by half a separation space from each other.

It is further been found advantageous that the section of the forwarding means 12, 13 which is located below at least one weft sled (e.g., sled P1 or DS) extending up to the needle bed, should run level. In this manner, it is provided that the exact loading of the threads in a predetermined mutual relationship, is not lost by the change in direction of the forwarding means 12, 13 before their knotting-in, in the fabric.

Figure 2:
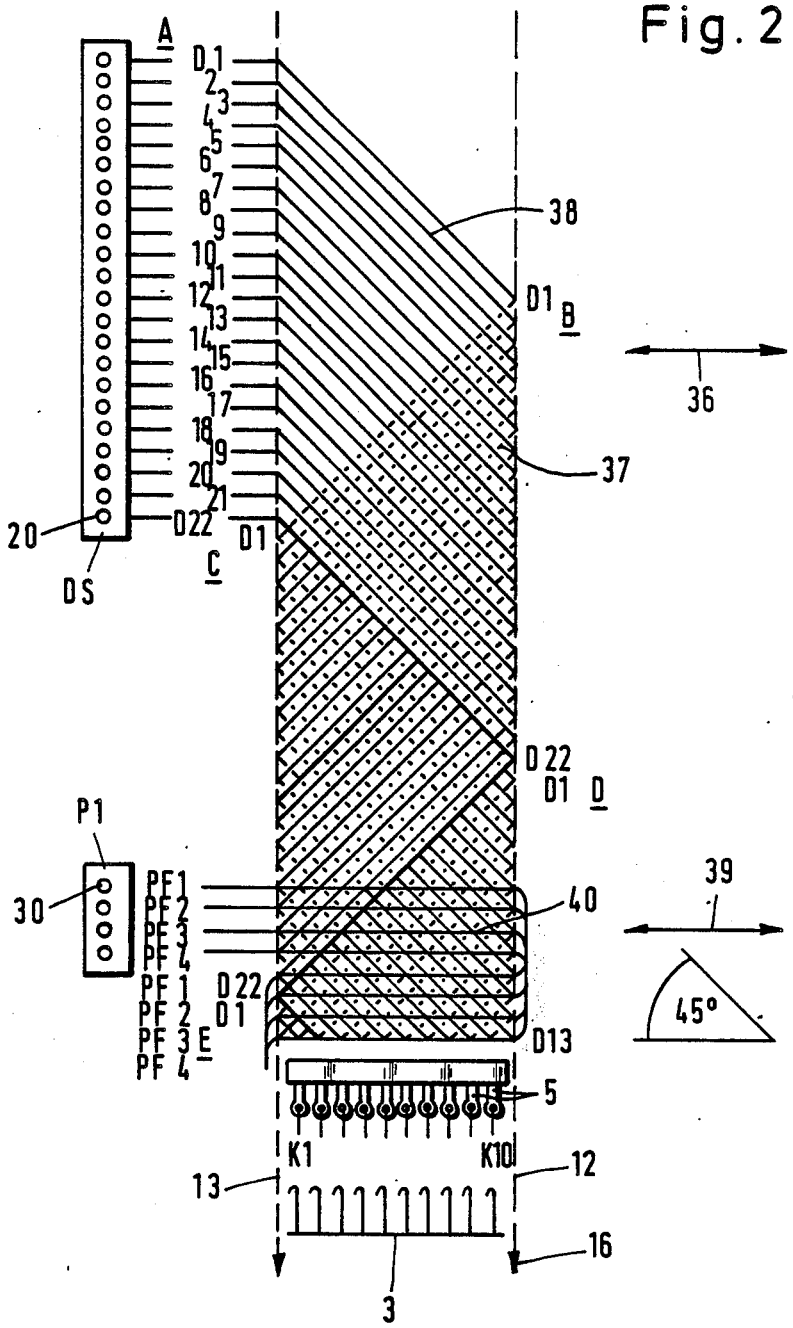
FIG. 2 is a downward plan view of a portion of the machine of FIG. 1 showing a first embodiment for weft thread laying.
Figure 3:
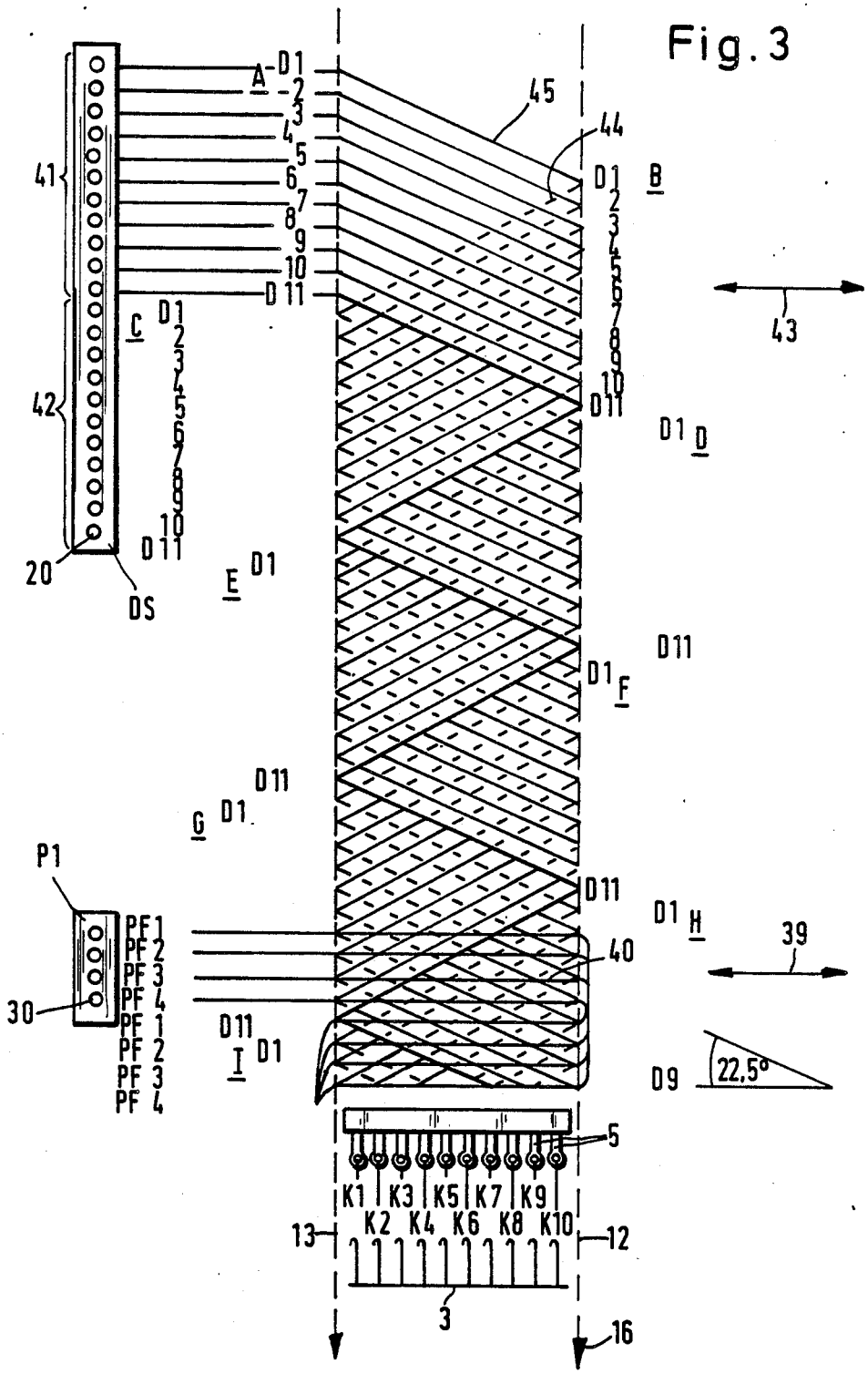
FIG. 3 is a partial, schematic, downward plan view of a portion of the machine of FIG. 1 showing a second type of weft thread laying.
Figure 4:
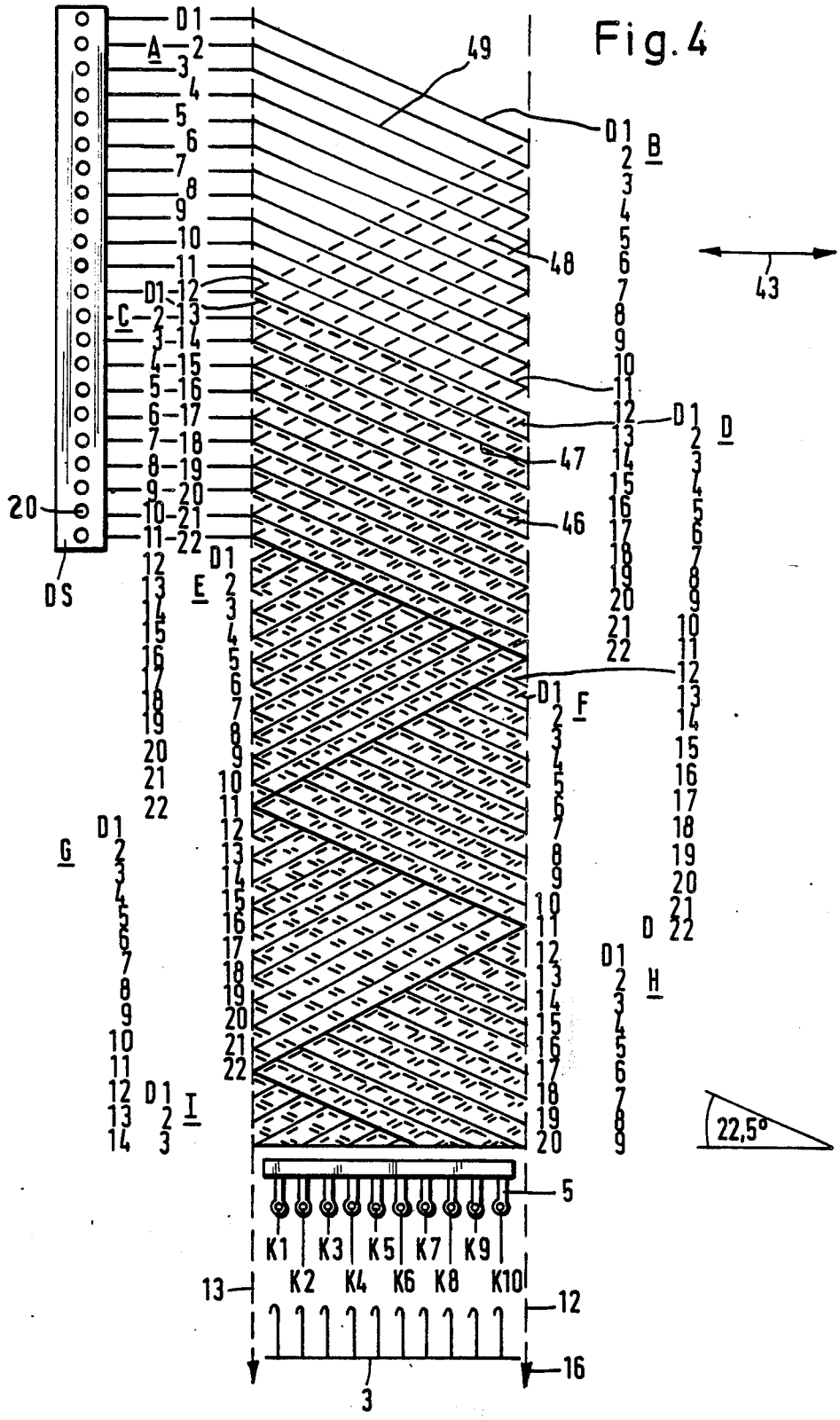
FIG. 4 is a downward, plan view of a portion of the machine of FIG. 1 showing a third type of weft thread laying.

It should be noted that in FIGS. 2 through 4 those diagonal weft threads from thread guides 20 (or 30) which are closest to the needle bed 3 are illustrated in heavier lines. These threads lie in the upper-most layers. In a simplified version of FIG. 2 there are illustrated 10 warp threads K1 through K10 which are provided to needle bed 3 through thread guides 5. In practice of course, the number is substantially higher. There may be utilized 100 or even 1,000 such needles and warp threads next to each other. The diagonal weft thread sled DS is illustrated as carrying 22 thread guides 20. Also this number, is in practice, quite substantially higher. It may comprise, as illustrated, rather more than double the number of needles in needle bed 3. Correspondingly, the diagonal weft threads D1 thru D22 are given up to the thread holders 14. When weft thread sled DS is moved to the right in direction of arrow 36, the transfer means 12 and 13 simultaneously move in the direction of arrow 16 to produce the diagonal weft thread layer 37 and the diagonal weft thread layer 38 when sled DS moves in the other direction. At directional transfer points A, B, C, D and E, there is provided a small displacement of thread guides 20 so that the weft threads are always laid about just one holder 14. It will thus be seen that in this manner, two crossing layers of diagonal threads can be laid by a single weft sled each at an angle of 45° to the stitch rows (that is the length of the fabric).

The horizontal weft sled (weft insert means) P1 in the illustrated Example, has four weft thread guides 30 which carry the horizontal weft insert threads PF1 thru PF4. In practice, this number is substantially greater, suitably between 12 and 24 thread guides. This horizontal weft thread P1 moves in the direction of double arrow 39 in a reciprocating manner and at the end of its path, is displaced perpendicular to the needle bed by a number of divisions corresponding to the number of thread guides 30. In this manner, there is provided a horizontal (perpendicular to the length of the fabric) weft thread layer 40 which is laid over the diagonal weft thread layers 37 and 38.

The greater the number of thread guides 20 the greater the angle subtended by the diagonal weft thread layers 37, 38 to the stitch wales. In a first embodiment the number of thread guides 20 is only slightly higher than the number of needles in the needle bed 3. In this manner, it is possible to achieve a subtended angle of somewhat more than 20°. The excess of thread guides 20 over needles 3 takes account of the fact that the diagonal weft threads D1–D22 must be laid with exact separation up to the forwarding means 12, 13 and these have a slightly greater separation from each other than the length of the needle bed 3.

In other embodiments, the number of thread guides 20 may be more than double the number of needles in the needle bed 3. In this manner, it is possible to provide a subtended angle for the diagonal angle of the weft threads D1–D22 of 45° and more.

As illustrated in FIG. 3, only sector 41 of the weft thread guides 20 are provided with diagonal weft threads D1 to D11, while a second sector 42 remains uncharged by threads. In contrast to the situation illustrated in FIG. 2, the diagonal weft thread sled DS is moved with twice the previous speed in the direction of arrow 43 in a reciprocating manner. This gives rise to two mutually crossing diagonal weft thread layers 44 and 45. Again, there are directional change points A thru I, each comprising a displacement of one division (predetermined spacing) of the holders 14. In this manner there are provided diagonal threads having an angle of 22.5° to the direction of the stitch wales. The horizontal weft insert sled P1 operates in a similar manner to that shown in FIG. 2.

In the embodiment of FIG. 4 the thread guides 20 on the diagonal weft thread sled DS are again charged with diagonal weft threads of D1 to D22. The movement of the sled DS again follows the reciprocal direction of arrow 43, as was the case in FIG. 3. Also the displacement at the turning points A thru I is always by one holder division. In this manner there are obtained four mutually crossing diagonal weft thread layers 46, 47, 48 and 49.

It is, therefor, possible to provide that the rate of travel of the sled DS is so great that the thread guides 20 on the sled DS proximal to the needle bed 3 lay the diagonal weft threads D1–D22 about the weft thread holders 12, 13 which, in an earlier cycle have already been provided with threads from another part of the thread guides 20 on sled DS. In this way there are provided at least four layers of mutually crossing diagonal weft threads D1–D22 utilizing but a single weft sled DS.

Figure 5:
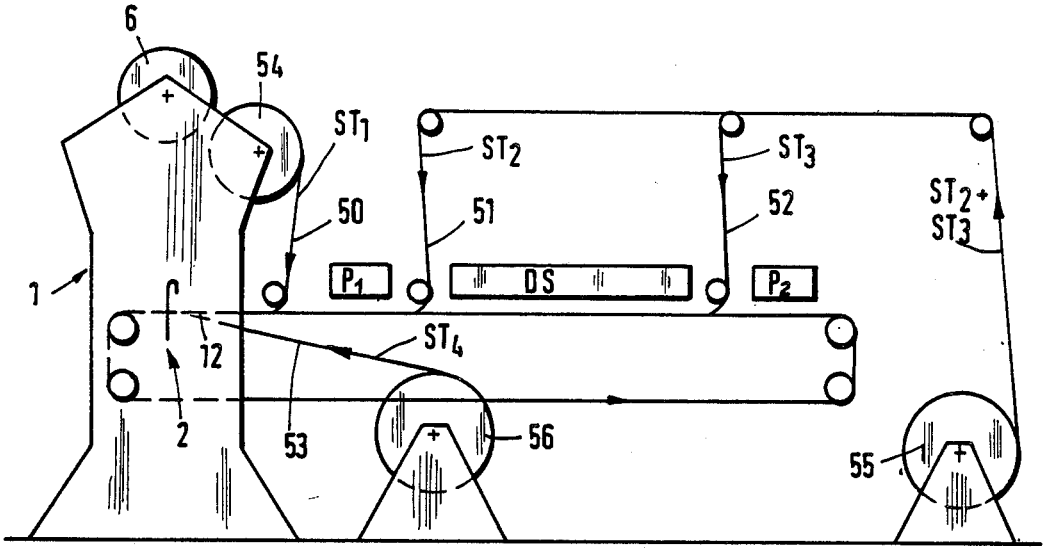
FIG. 5 is a schematic, side elevational view of another embodiment of a warp knitting machine according to the principles of the present invention.

In the embodiment of FIG. 5 further elements are added to the basic machines illustrated in FIG. 1. In addition to the diagonal weft sled DS and the horizontal weft insert means P1 there is provided yet another horizontal weft insert means P2 which is constructed in a manner similar to that of weft insert means P1. The diagonal weft sled DS is located between both horizontal weft sleds P1 and P2. Additionally, four warps 50, 51, 52 and 53 of warp inlay threads ST1 thru ST4, acting as warp inlay means, are provided from the corresponding warp beams 54, 55 and 56 over turning rollers which are not specifically indicated. The first inlay thread warp 50 is provided as a covering means or layer between the working area 2 and the first horizontal weft sled P1. The second inlay thread warp 51 is provided between sled P1 and sled DS, the third inlay thread warp 52 is provided between sleds DS and P2, and the fourth inlay thread warp 53 is provided as a lower covering means or layer between the working area 2 and the first weft sled P1.

Figure 6:
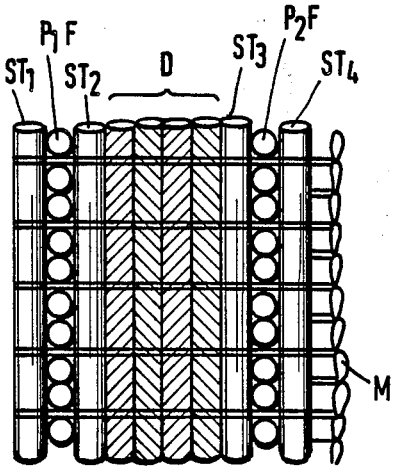
FIG. 6 is a plan view of a type of fabric produced on a machine as illustrated in FIG. 5.

When the diagonal weft sled DS is operated in the manner shown in FIG. 4 there is provided a fabric such as that illustrated in FIG. 6. In this fabric the layers of reinforcing threads are oriented in the following manner: Warp inlay threads ST1 are the upper covering layer followed by, respectively, the transverse weft threads P1F, the inner warp inlay threads ST2, four layers of diagonal weft threads D, further inner warp inlay threads ST3, transverse weft inlay threads P2F and a lower covering layer of warp inlay threads ST4; which are all held together by stitches M made from warp threads K1 to K10. It will be seen that the warp inlay threads ST1 to ST4 are always separated from each other by weft threads and thus, although they are parallel and run with separation from each other, always maintain their position.

Needless to say, utilizing the above described warp knitting machine, there may be produced warp knitted fabric with a smaller number of diagonal weft threads, transverse (horizontal) weft threads and warp inlay thread layers lying upon each other. In any event, however, it is possible to provide two layers of mutually crossing diagonal weft threads by means of a single sled DS.

In this manner one may achieve fabric with extraordinary strength in the diagonal direction, since at least double the normal number of diagonal weft threads are provides which, moreover, are distributed in the fabric in an extremely regular manner.

On both sides of the at least four layers of diagonal weft threads D there can be provided at least one layer of warp inlay threads and/or transverse weft threads. It is thus possible to provide a fabric having a plurality of layers of reinforcing threads and there may thus be obtained a high level of stability. Thus, it is possible to provide a plurality of layers of reinforcing threads in a warp knitted fabric in fewer working steps than was possible in the previous precedures. Previously, in order to obtain the same effect, it was necessary to produce several fabric panels with a smaller number of reinforcing thread layers, soak them in a synthetic material and then layer them upon each other. The present procedure also requires the use of a smaller amount of such synthetic material.

It is especially preferred to provide a warp knitted fabric in which, on both sides of the at least four layers of diagonal weft threads D, there is provided an inner layer of warp inlay threads ST2, ST3, a layer of transverse weft threads P1F, P2F and an an outer outer layer ST1, ST4 of warp inlay threads. In this arrangement, the warp inlay threads ST1-ST4 are always separated from each other by weft threads. There is thus no danger that the weft threads of a first laying are displaced sidewards by the warp inlay threads of a second laying.

The concept of a warp inlay thread layer should also include a "non-woven substrate" or other flat object. Insofar as mention has been made of "threads" these should also be considered to include groups of threads, strips and the like. The basic stitch can be produced in whatever manner is desired, for example, piller or tricot. The needles of the needle bed 3 can have sharpened heads in order to penetrate the reinforcing threads.

In order to produce, on the same warp knitting machine, different types of diagonal weft inlays, it is desirable to provide intermediate gearing. For example, gear wheels and the like with whose assistance the speed of the diagonal weft thread sled DS relative to that of the transfer means 12 and 13 can be changed at will. The effective weft thread breadth, that is to say, the number of charged weft thread guides can be altered as desired.

When the holders of one forwarding means relative to the other forwarding means are displaced by half a holder division, the eccentric cam 23 must be correspondingly amended.

Obviously, many modifications and variations of the present invention are possible in light of the above teachings. It is, therefore, to be understood that within the scope of the appended claims, the invention may be practiced otherwise than as specifically described.

What is claimed is:

1. A warp knitting machine employing insert threads and warp inlay threads and having a bed of needles and a magazine for weft threads, comprising:

a pair of endless transfer means each having weft thread holding means, spaced with a predetermined spacing, for retaining said weft threads in parallel and delivering them to said needle bed in a predetermined direction;

a weft thread sled means having a plurality of thread guides for reciprocating between said pair of transfer means to insert said weft threads in mutually and diagonally crossing layers, each of said layers having a mutually opposed orientation to stitch wales produced by said needles, said layers running alternately between the weft thread holding means of each of said transfer means, said thread guides being greater in number than said needles, said thread guides being operable when reversing direction to lay each of said weft threads around only one weft thread holding means at that time, said weft thread sled means being operable to move transversely to said predetermined delivery direction at a reciprocating speed to lay the weft threads of at least one of the thread guides proximal to said needle bed in a position, next to and displaced by one transfer means division from, at least one of the weft threads laid by at least one of the thread guides distal to the needle bed in an earlier cycle;

weft thread insert means for providing said insert threads in a layer and perpendicular to said predetermined delivery direction; and at least one warp inlay means for providing across the width of the needle bed and from the warp inlay threads, at least one thread layer inserted downstream from the outermost one of said weft thread insert means and said weft thread sled means, to be carried by said transfer means.

2. A warp knitting machine in accordance with claim 1 wherein the number of thread guides is more than twice the number of needles in the bed.

3. A warp knitting machine in accordance with claim 1 wherein the speed of the sled means is of a magnitude to cause a portion of the thread guides proximal to the needle bed to lay the diagonal weft threads into weft holders which have already received diagonal weft threads from another, distal portion of the thread guides in an earlier cycle.

4. A warp knitting machine in accordance with claim 1 wherein said warp inlay means is operable to provide across the width of the needle bed and from the warp inlay threads, a first layer running between said weft thread sled means and said weft thread insert means and a second layer running between the needle bed and the closer one of said insert and sled means.

5. A warp knitting machine in accordance with claim 4 wherein said warp inlay means is complemented by further comprising:

another warp inlay means for providing across the width of the needle bed and from the warp inlay threads, a layer running between the needle bed and the closer one of said insert and sled means.

6. A warp knitting machine in accordance with claim 1 employing warp threads, and wherein said weft thread insert means is complemented to comprise:

a pair of weft thread insert means, the weft thread sled means being provided between said pair of weft thread insert means; and warp inlay means for inserting a layer of the warp inlay threads before and after the weft thread sled means.

7. A warp knitting machine in accordance with claim 6 comprising:

at least one cover means for providing a covering layer with the warp inlay threads proximate to the needle bed.

8. A warp knitting machine in accordance with claim 1 wherein the portion of the transfer means located under the weft thread sled means and running to the proximity of the needle bed, runs in a level plane.

9. A warp knitting machine in accordance with claim 1, comprising:

a separating means for separating the weft threads from the weft thread holding means, said separating means being spaced downstream from said thread guides with a separation corresponding to at least five times in magnitude said predetermined spacing.

10. A warp knitting machine in accordance with claim 9 wherein the weft thread holding means on both said transfer means are displaced in relation to each other by half of said predetermined spacing.

11. A warp knitting machine in accordance with claim 1 wherein the needle bed comprises:

holding down means having upwardly extending control means.

* * * * *